US006523232B2

(12) United States Patent
Chen

(10) Patent No.: US 6,523,232 B2
(45) Date of Patent: Feb. 25, 2003

(54) ZIPPER SLIDE

(76) Inventor: Tan Ming Chen, No.165, Lane 256, Sec.2, Chung Shan N. Rd., Yang Mei Jen, Taoyuan Hsien (TW)

( * ) Notice: Subject to any disclaimer, the term of this patent is extended or adjusted under 35 U.S.C. 154(b) by 0 days.

(21) Appl. No.: 09/988,450

(22) Filed: Nov. 20, 2001

(65) Prior Publication Data

US 2002/0108218 A1 Aug. 15, 2002

(30) Foreign Application Priority Data

Feb. 14, 2001 (TW) ..... 90202225 U

(51) Int. Cl.[7] ..... A44B 19/30

(52) U.S. Cl. ..... 24/431; 24/418; 24/419; 24/429

(58) Field of Search ..... 24/429, 431, 415, 24/424, 425, 418, 419, 420, 421

(56) References Cited

U.S. PATENT DOCUMENTS

| | | | | |
|---|---|---|---|---|
| 5,068,950 A | * | 12/1991 | Yuki | 24/429 |
| 5,195,221 A | * | 3/1993 | Kanamaru et al. | 24/429 |
| 5,729,874 A | * | 3/1998 | Mizuno | 24/429 |
| 5,884,373 A | * | 3/1999 | Kawamura | 24/421 |
| 6,438,806 B1 | * | 8/2002 | Lin | 24/433 |

* cited by examiner

*Primary Examiner*—Robert J. Sandy
(74) *Attorney, Agent, or Firm*—Rosenberg, Klein & Lee

(57) ABSTRACT

A zipper slide is constructed to include a slide body adapted for closing/opening zipper tapes, the slide body having a top block, a hollow slide handle adapted for the gripping of the fingers to move the slide body, the slide handle having a decorative color design, a locating plate fastened to the inside of the slide handle, a coupling member mounted inside the slide handle and covered on the top block of the slide body, and a retaining plate, which secures the coupling member to the locating plate in the slide handle and the top block of the slide body.

14 Claims, 7 Drawing Sheets

ZIPPER SLIDE

BACKGROUND OF THE INVENTION

The present invention relates to zippers and, more particularly, to a zipper slide for zipper, which is equipped with a slide handle of a particular design to show a personal style.

FIG. 1 illustrates a slide and pull tab assembly 1 for zipper according to the prior art. This structure of slide and pull tab assembly 1 comprises a slide body 11, and a pull tab 10 coupled to the slide body 11. Through the pull tab 10, the slide body 11 is moved to close/open the zipper tapes (not shown). This structure of slide and pull tab assembly is functional, however its monotonous outer appearance does not show a personal style. When installed in the cloth or bag, the slide and pull tab assembly may be not in perfect match with the design of the cloth or bag.

SUMMARY OF THE INVENTION

The present invention has been accomplished under the circumstances in view. It is therefore the main object of the present invention to provide a zipper slide, which shows a personal style, and provides a particular decorative design. To achieve these and other objects of the present invention, the zipper slide comprises a slide body, the slide body comprising a top block, the top block comprising a retaining hole; a slide handle, the slide handle comprising a bottom open chamber, and a locating groove transversely extended in the bottom open chamber; a locating plate fastened to the locating groove inside the slide handle; a coupling member mounted in the bottom open chamber of the slide handle and covered on the top block of the slide body; and a retaining plate mounted in the slide handle and fastened to the locating plate to secure the coupling member to the locating plate and engaged into the retaining hole of the top block of the slide body to secure the coupling member to the slide body.

DETAILED DESCRIPTION OF THE PREFERRED EMBODIMENT

Figure 1:
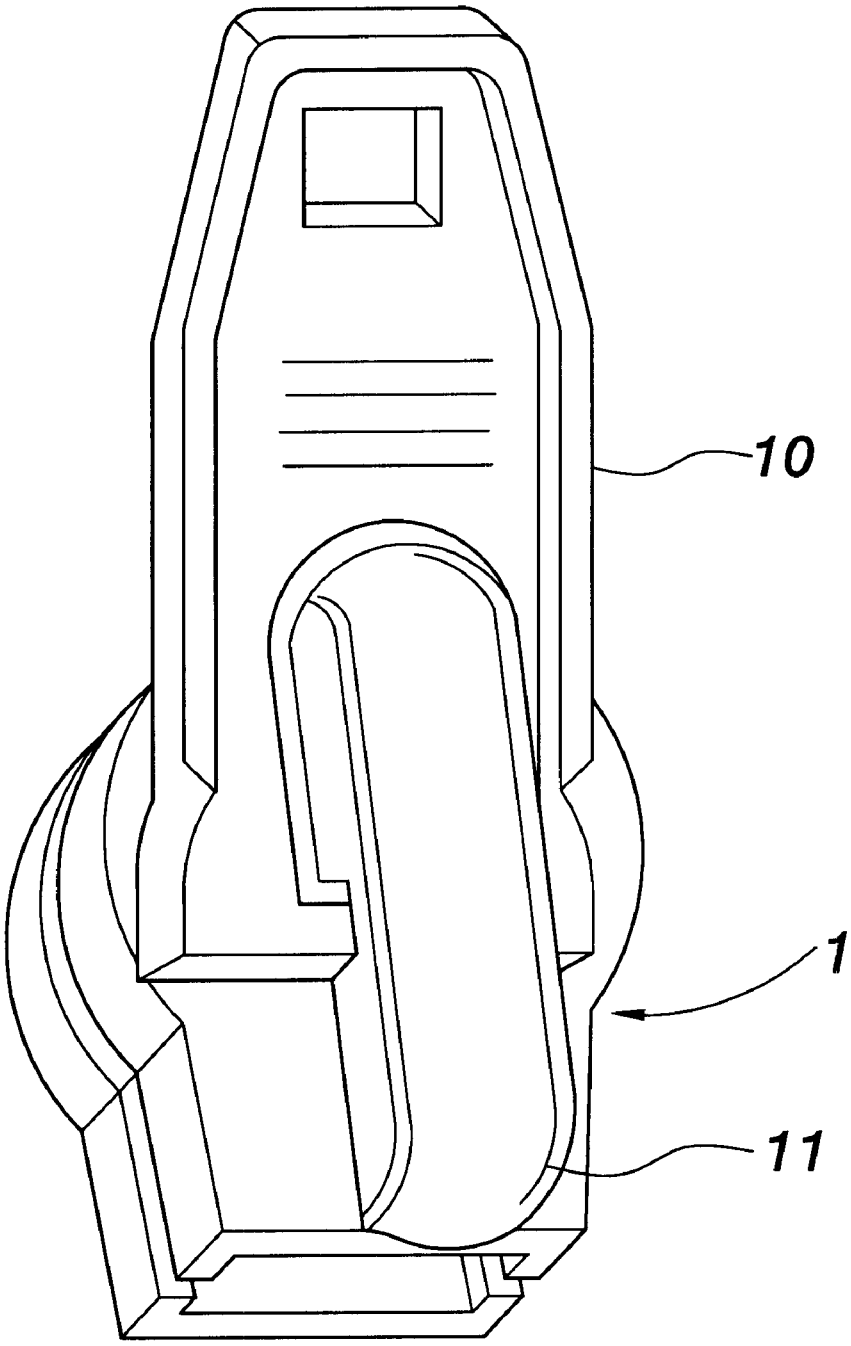
FIG. 1 PRIOR ART
FIG. 1 is an elevational view of a zipper slide and pull tab assembly constructed according to the prior art.
Figure 2:
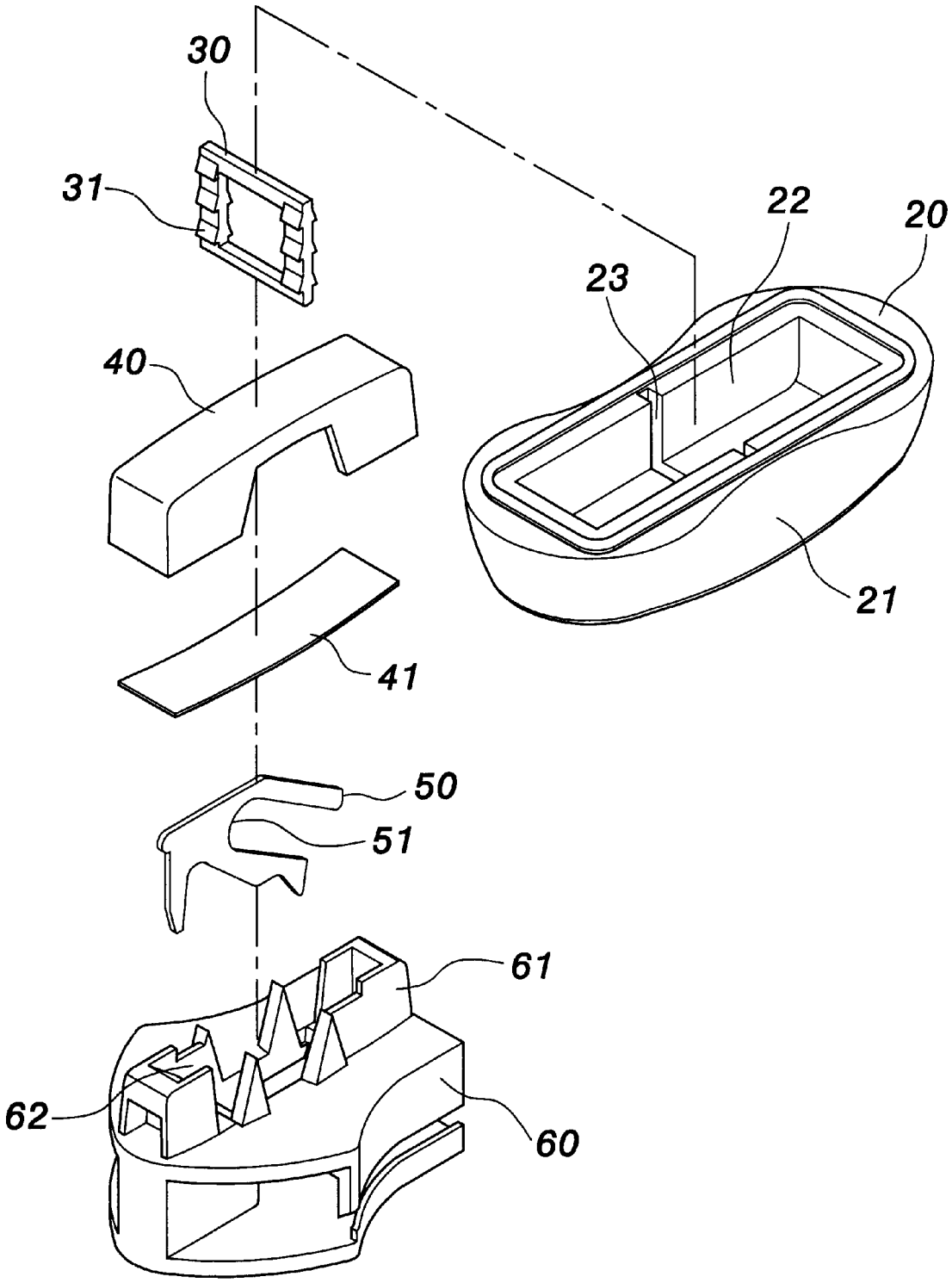
FIG. 2 is an exploded view of a zipper slide constructed according to the present invention.
Figure 3:
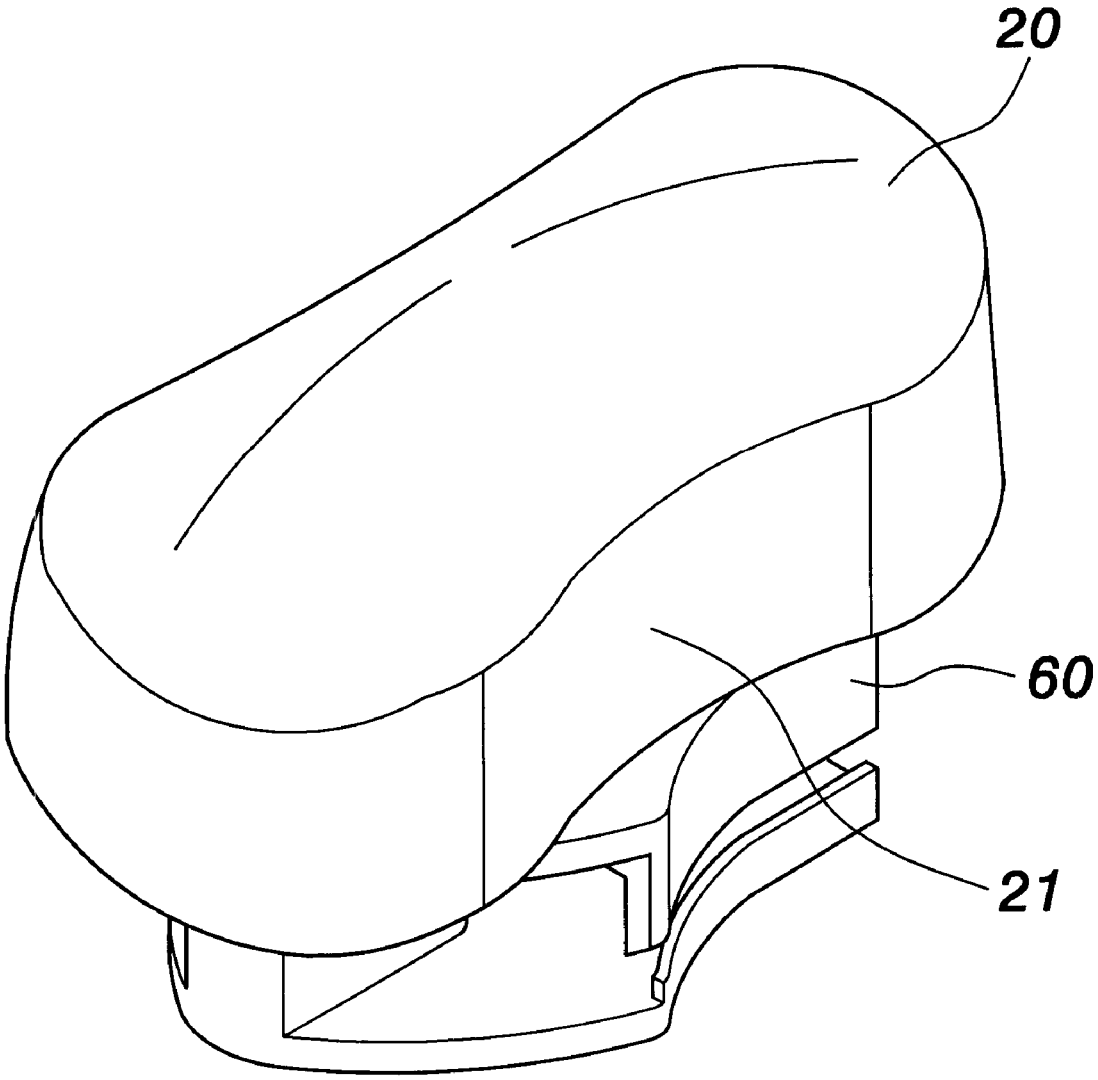
FIG. 3 is an elevational assembly view of the zipper slide according to the present invention.
Figure 4:
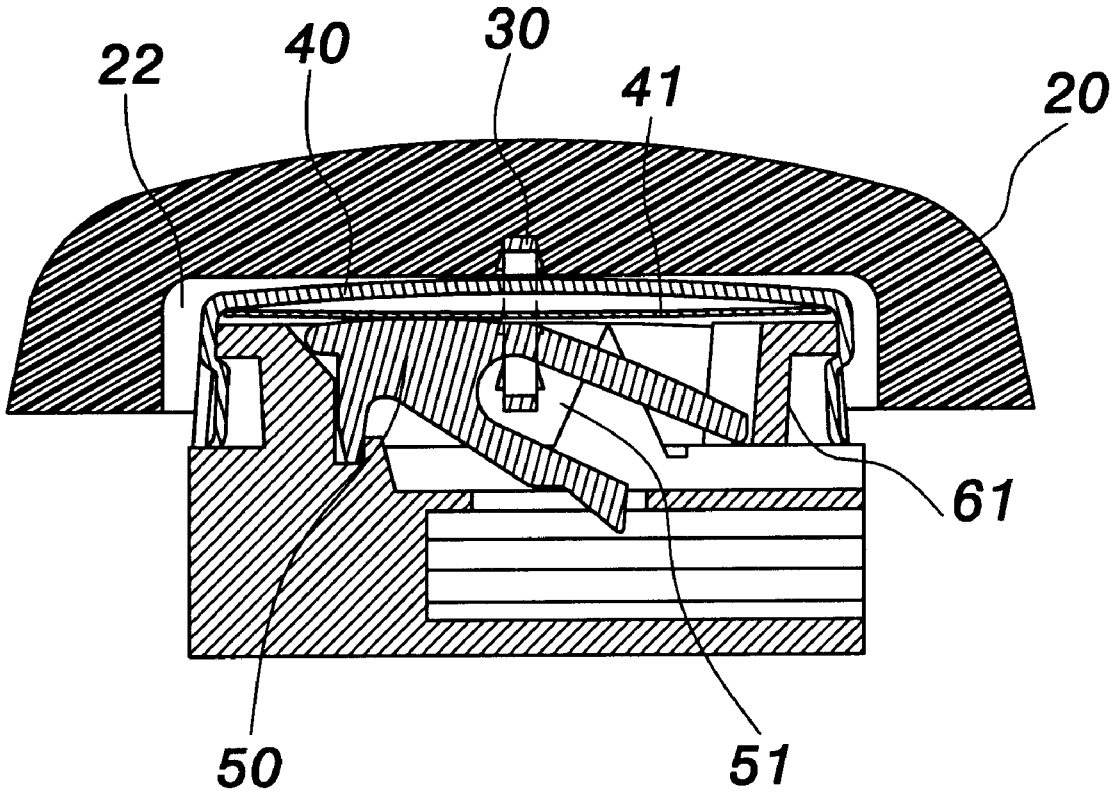
FIG. 4 is a sectional view of the zipper slide according to the present invention.

Referring to FIGS, from 2 through 4, a zipper slide is shown comprised of a slide handle 20, a locating plate 30, a coupling member 40, a retaining plate 50, and a slide body 60.

Figure 5:
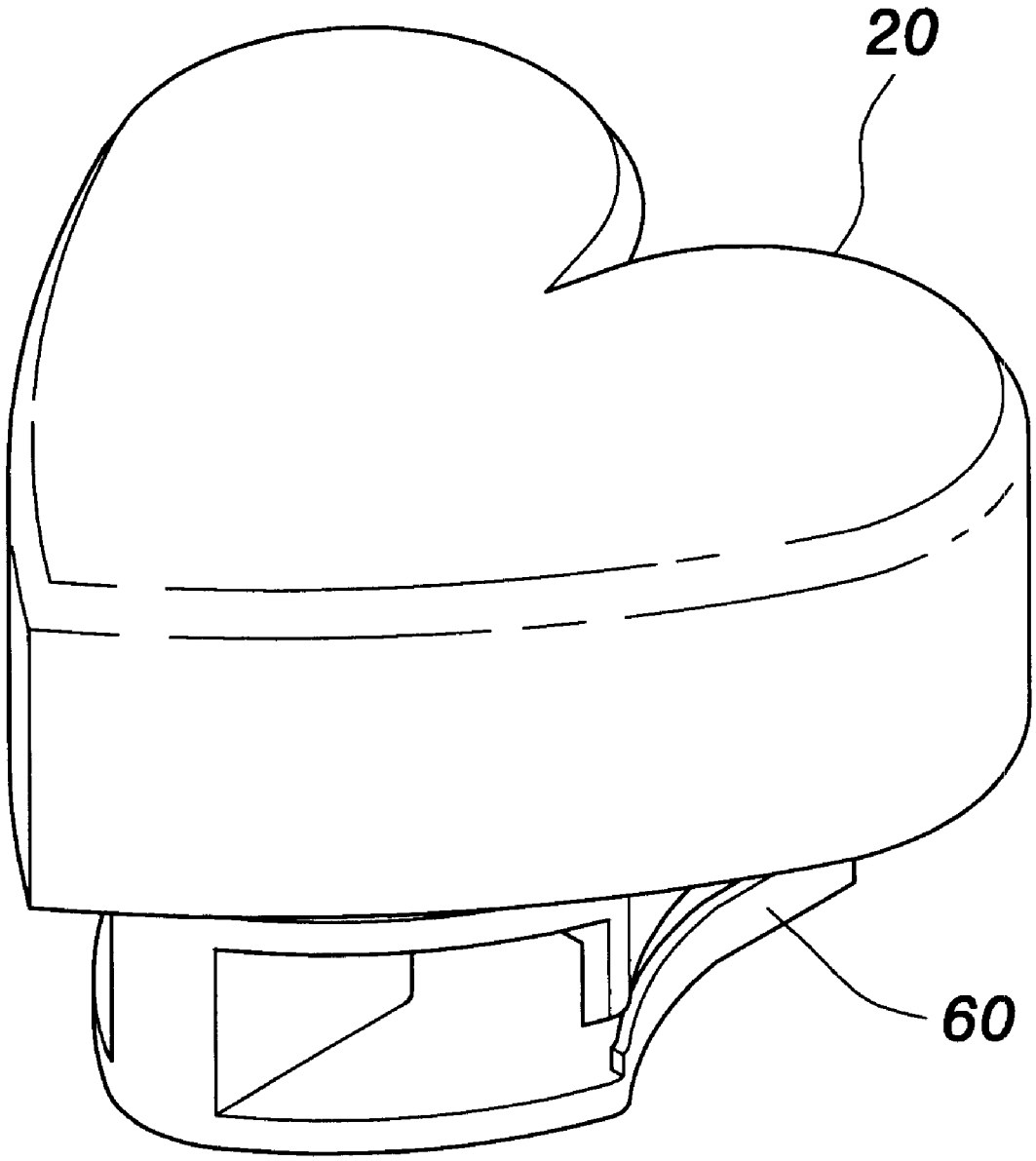
FIG. 5 is an elevational view of an alternate form of the present invention.
Figure 6:
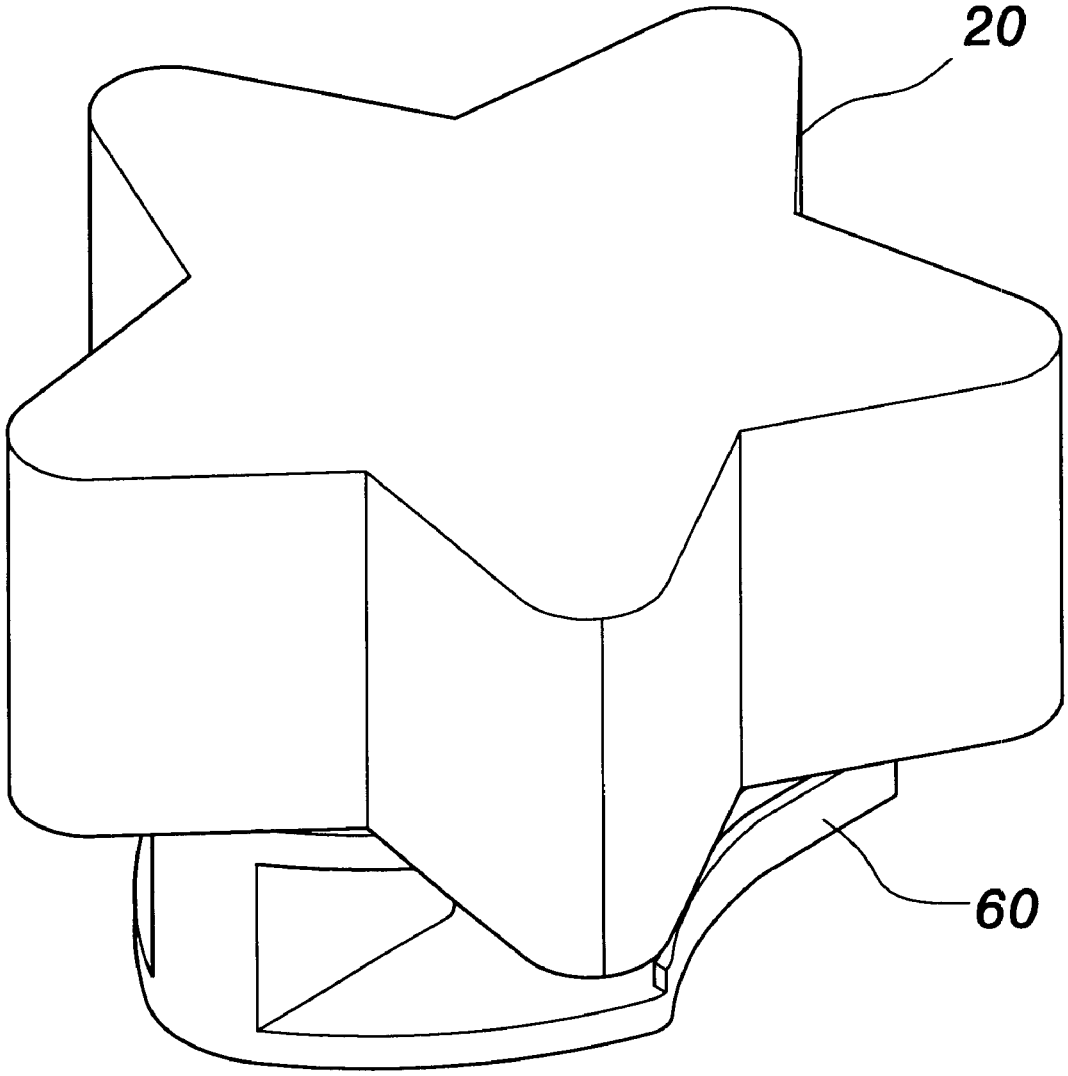
FIG. 6 is an elevational view of another alternate form of the present invention.

The slide handle 20 is made in integrity of metal, plastics, or rubber, having a circular, triangular, oval, rectangular, or polygonal shape, or any of a variety of shapes in any of a variety of colors. For example, the slide handle shown in FIG. 5 has a heart-like shape; the slide handle shown in FIG. 6 is shaped like a star. The slide handle 20 has two opposite sidewalls 21 respectively curved inwards convenient for the gripping of the fingers, a bottom open chamber 22 adapted for receiving the coupling member 40, and a locating groove 23 transversely extended in the bottom open chamber 22 and adapted for receiving the locating plate 30. The locating plate 30 is mounted in the locating groove 23 to hold the coupling member 40 inside the bottom open chamber 22, having a plurality of engagement teeth 31 protruded from two opposite sides thereof and forced into friction-engagement with the peripheral wall of the locating groove 23. According to the present preferred embodiment, the locating plate 30 is made of a rectangular open frame. The coupling member 40 is internally reinforced with a spring plate 41. The retaining plate 50 is mounted inside the coupling member 40 and fastened to the slide body 60 to secure the coupling member 40 to the slide body 60, having a retaining portion 51 secured to the locating plate 30. The slide body 60 comprises a top block 61 defining a retaining hole 62 adapted for receiving the retaining plate 50. Further, the coupling member 40 is a hollow, cap-like member fitting over the top block 61 of the slide 60; the slide handle 20 can be made of metal or injection-molded from transparent or opaque plastic/rubber material, having a color design in it.

The assembly process of the present invention is outlined hereinafter with reference to FIGS. from 2 through 4. The coupling member 40 is inserted with the retaining plate 50 through the locating plate 30, forcing the retaining portion 51 of the retaining plate 50 into positive engagement with the locating plate 30. After connection of the coupling member 40 and the retaining plate 50 to the locating plate 30, the retaining plate 50 is engaged into the retaining hole 62 of the top block 61 of the slide body 60, enabling the coupling member 40 to be covered on the top block 61 of the slide body 60. At final, the locating plate 30 is fastened to the locating groove 23 of the slide handle 20, for enabling the coupling member 40 to be received inside the bottom open chamber 22 of the slid handle 20. When assembled, the slide handle 20 functions as a pull tab for pulling by hand to move the slide body 60. In addition to the function of serving as a pull tab, the slide handle 20 serves as an ornament to the slide body 60.

Figure 7:
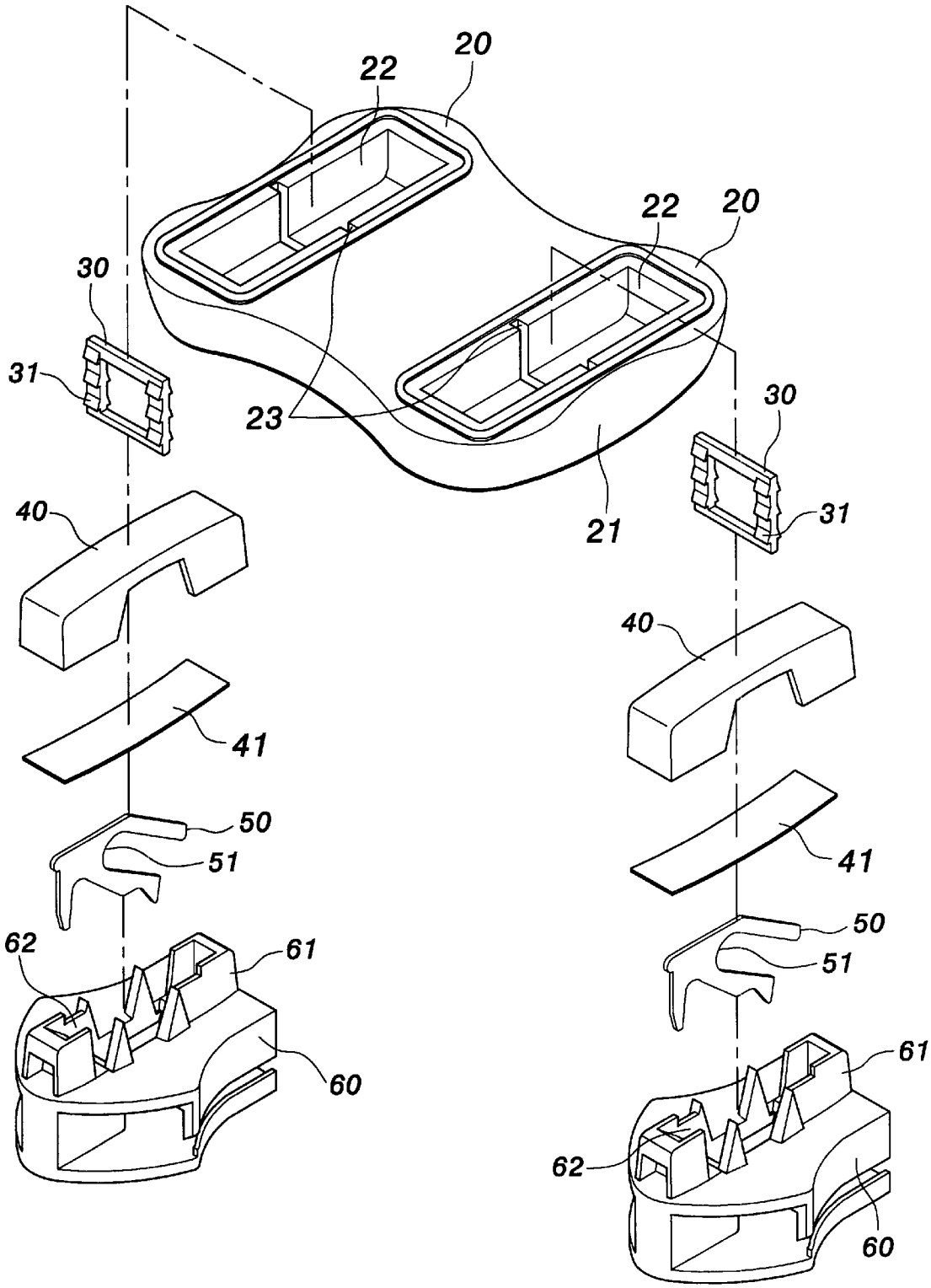
FIG. 7 is an elevational view of again alternate form of the present invention.

FIG. 7 shows an alternate form of the present invention. According to this alternate form, the slide handle 20 is relatively greater in size than the embodiment shown in FIGS. from 2 through 6, having two bottom open chambers 22, each coupled to a respective locating plate 30, a respective coupling member 40, a respective retaining plate 50, and a respective slide body 60.

A prototype of zipper slide has been constructed with the features of the annexed drawings of FIGS. 2~6. The zipper slide functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A zipper slide comprising:

a slide body, said slide body comprising a top block, said top block comprising a retaining hole;

a slide handle, said slide handle comprising a bottom open chamber, and a locating groove transversely extended in said bottom open chamber;

a locating plate fastened to the locating groove inside said slide handle;

a coupling member mounted in the bottom open chamber of said slide handle and covered on the top block of said slide body; and a retaining plate mounted in said slide handle and fastened to said locating plate to secure said coupling member to said locating plate and engaged into the retaining hole of said top block of said slide body to secure said coupling member to said slide body.

2. The zipper slide as claimed in claim 1 wherein said slide handle is made of metal in integrity.

3. The zipper slide as claimed in claim 1 wherein said slide handle is injection-molded from plastic.

4. The zipper slide as claimed in claim 1 wherein said slide handle is molded from rubber material.

5. The zipper slide as claimed in claim 1 wherein said slide handle has two opposite lateral sidewalls respectively curved inwards for the gripping of the fingers.

6. The zipper slide as claimed in claim 1 wherein said slide handle is shaped like a heart.

7. The zipper slide as claimed in claim 1 wherein said slide handle is shaped like a star.

8. The zipper slide as claimed in claim 1 wherein said slide handle has a triangular shape.

9. The zipper slide as claimed in claim 1 wherein said slide handle has a polygonal shape.

10. The zipper slide as claimed in claim 1 wherein said slide handle is colored with at least one color.

11. The zipper slide as claimed in claim 1 wherein said slide handle is transparent.

12. The zipper slide as claimed in claim 1 wherein said slide handle further comprises a second bottom chamber adapted for coupling to a second locating plate, a second coupling member, a second retaining plate, and a second slide body.

13. The zipper slide as claimed in claim 1 wherein said coupling member is internally reinforced with a spring plate.

14. The zipper slide as claimed in claim 1 wherein said locating plate has engagement teeth protruded from two opposite sides thereof and forced into engagement with peripheral wall of said locating groove of said slide handle.

* * * * *